United States Patent [19]

Ruge et al.

[11] Patent Number: 4,676,757

[45] Date of Patent: Jun. 30, 1987

[54] OUTBOARD MOTOR TILT LOCK DEVICE

[75] Inventors: Paul M. Ruge, Vernon Hills; Robert W. Woodard, Waukegan, both of Ill.

[73] Assignee: Outboard Marine Corporation, Waukegan, Ill.

[21] Appl. No.: 830,624

[22] Filed: Apr. 7, 1986

[51] Int. Cl.[4] ..... B63H 21/26

[52] U.S. Cl. ..... 440/55; 248/643

[58] Field of Search ..... 440/55, 56, 900, 63; 248/641, 643; 16/347; 292/230, 231, 234, 238; 74/532

[56] References Cited

U.S. PATENT DOCUMENTS

| | | | |
|---|---|---|---|
| 1,785,343 | 12/1930 | Gilbert | 16/347 X |
| 2,126,579 | 8/1938 | Roethel | 16/347 |
| 2,207,372 | 7/1940 | Clarke | 115/18 |
| 2,824,463 | 2/1958 | Gleasman et al. | 74/532 |
| 3,371,893 | 3/1968 | Blanchard, Jr. | 248/4 |
| 3,666,218 | 5/1972 | Hagen | 248/4 |
| 3,785,329 | 1/1974 | Shimanckas | 115/41 |
| 4,094,482 | 6/1978 | Weaver | 440/900 X |
| 4,331,430 | 5/1982 | Lutzke et al. | 440/53 |
| 4,331,431 | 5/1982 | Estes | 440/53 |
| 4,402,675 | 9/1983 | Eichinger | 440/53 |
| 4,419,083 | 12/1983 | Taguchi | 440/56 |
| 4,493,659 | 1/1985 | Iwashita | 440/61 |

*Primary Examiner*—Sherman D. Basinger
*Attorney, Agent, or Firm*—Michael, Best & Friedrich

[57] ABSTRACT

A marine propulsion device comprising a transom bracket adapted to be mounted on the transom of a boat, a swivel bracket mounted on the transom bracket for pivotal movement relative to the transom bracket about a generally horizontal tilt axis and between an operating position and a raised position, a propulsion unit including a rotatably mounted propeller and being mounted on the swivel bracket for pivotal movement relative to the swivel bracket about a generally vertical steering axis, a member mounted on the transom bracket for movement relative thereto between a first position wherein the member permits location of the swivel bracket in the operating position, and a second position spaced from the first position, the member being gravitationally biased toward the second position, a surface on the swivel bracket for engaging the member when said member is in said second position to hold said swivel bracket in said raised position, and a projection on the swivel bracket for moving the member to the first position in response to movement of the swivel bracket to the operating position from the raised position.

20 Claims, 6 Drawing Figures

OUTBOARD MOTOR TILT LOCK DEVICE

BACKGROUND OF THE INVENTION

The invention relates to marine propulsion devices and, more particularly, to means for holding the swivel bracket of a marine propulsion device mounting assembly in the raised position.

A typical outboard motor comprises a mounting assembly including a transom bracket mounted on the transom of a boat, and a swivel bracket mounted on the transom bracket for pivotal movement relative to the transom bracket about a generally horizontal tilt axis and between an operating position and a raised position. Many means are known for holding the swivel bracket in the raised position. Such means often have complicated constructions and/or are difficult to operate.

Attention is direction to the following U.S. patents which disclose swivel bracket holding means:

| | | |
|---|---|---|
| Clarke | 2,207,372 | July 9, 1940 |
| Blanchard | 3,371,893 | March 5, 1968 |
| Hagen | 3,666,218 | May 30, 1972 |
| Shimanckas | 3,785,329 | Jan. 15, 1974 |
| Lutzke | 4,331,430 | May 25, 1982 |
| Estes | 4,331,431 | May 25, 1982 |
| Eichinger | 4,402,675 | Sept. 6, 1983 |
| Taguchi | 4,419,083 | Dec. 6, 1983 |
| Iwashita | 4,493,659 | Jan. 15, 1985 |

SUMMARY OF THE INVENTION

The invention provides a marine propulsion device comprising a transom bracket adapted to be mounted on the transom of a boat, a swivel bracket mounted on the transom bracket for pivotal movement relative to the transom bracket about a generally horizontal tilt axis and between an operating position and a raised position, a propulsion unit including a rotatably mounted propeller and being mounted on the swivel bracket for pivotal movement relative to the swivel bracket about a generally vertical steering axis, a member mounted on one of the swivel bracket and the transom bracket for movement relative thereto between a first position wherein the member permits location of the swivel bracket in the operating position, and a second position spaced from the first position, the member including means for gravitationally biasing the member toward the second position, means on the other of the swivel bracket and the transom bracket for engaging the member when the member is in the second position to hold the swivel bracket in the raised position, and means on the other of the swivel bracket and the transom bracket for moving the member to the first position in response to movement of the swivel bracket to the operating position from the raised position.

In one embodiment, the other of the swivel bracket and the transom bracket includes a projection extending generally radially from the tilt axis, and the means for moving the member to the first position includes the projection.

In one embodiment, the means for engaging the member includes the projection.

In one embodiment, the device further comprises stop means on the one of the swivel bracket and the transom bracket for preventing movement of the member beyond the second position.

The invention also provides a marine propulsion device comprising a transom bracket adapted to be mounted on the transom of a boat, a swivel bracket mounted on the transom bracket for pivotal movement relative to the transom bracket about a generally horizontal tilt axis and between an operating position and a raised position, a propulsion unit including a rotatably mounted propeller and being mounted on the swivel bracket for pivotal movement relative to the swivel bracket about a generally vertical steering axis, a member mounted on one of the swivel bracket and the transom bracket for movement relative thereto between a first position wherein the member permits location of the swivel bracket in the operating position, and a second position spaced from the first position and wherein the member engages the other of the swivel bracket and the transom bracket for holding the swivel bracket in the raised position, the member including means for gravitationally biasing the member toward the second position, and means on the other of the swivel bracket and the transom bracket for moving the member to the first position in response to movement of the swivel bracket to the operating position from the raised position.

The invention also provides a marine propulsion device comprising a transom bracket adapted to be mounted on the transom of a boat, a swivel bracket mounted on the transom bracket for pivotal movement relative to the transom bracket about a generally horizontal tilt axis and between an operating position and a raised position, a propulsion unit including a rotatably mounted propeller and being mounted on the swivel bracket for pivotal movement relative to the swivel bracket about a generally vertical steering axis, a member mounted on the transom bracket for pivotal movement relative to the transom bracket about a generally horizontal pivot axis and between a first position wherein the member permits location of the swivel bracket in the operating position, and a second position spaced from the first position, the member including a weighted portion gravitationally biasing the member toward the second position, and the member being manually movable from the second position toward the first position, means on the swivel bracket for engaging the member when the member is in the second position to hold the swivel bracket in the raised position, and means on the swivel bracket for moving the member to the first position only after manual movement of the member from the second position and in response to movement of the swivel bracket to the operating position from the raised position.

A principal feature of the invention is the above-described means for holding the swivel bracket in the raised position. This holding means is easy to operate, is extremely effective, and has a simple construction.

Other principal features and advantages of the invention will become apparent to those skilled in the art upon review of the following detailed description, claims and drawings.

Figure 1:
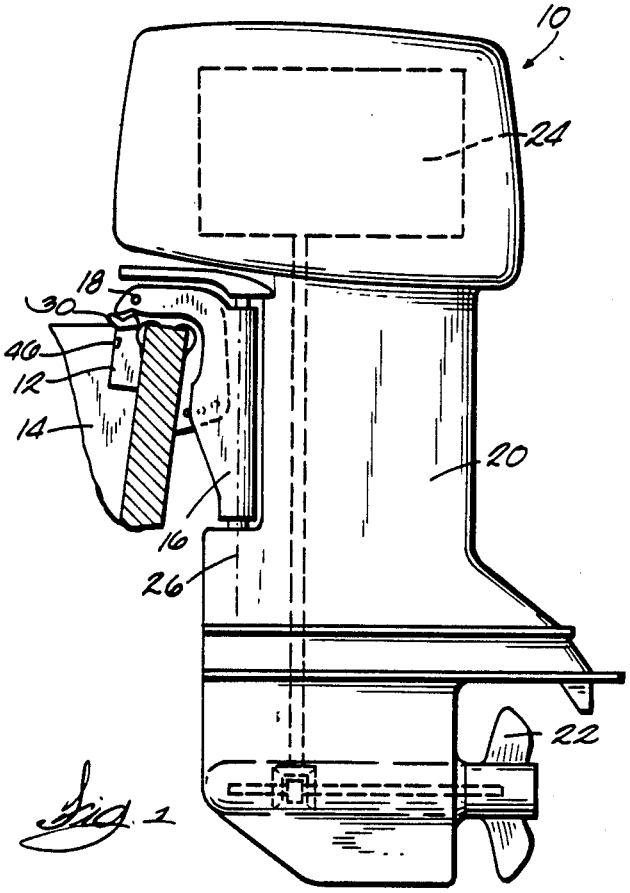
FIG. 1 is a side elevational view of a marine propulsion device which embodies various of the features of the invention and which includes a swivel bracket movable between an operating position and a raised position.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 2:
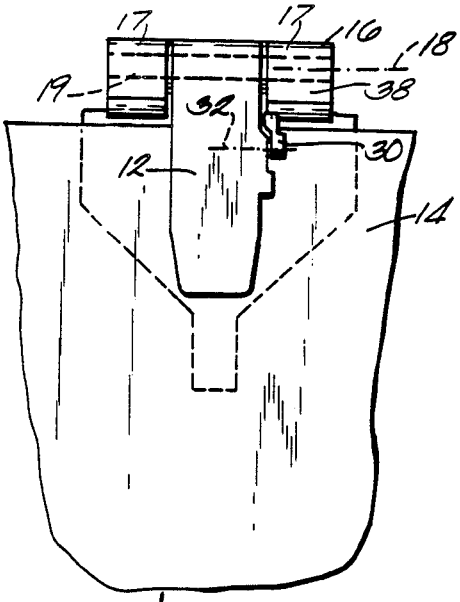
FIG. 2 is an enlarged, partial, front view of the marine propulsion device.
Figure 5:
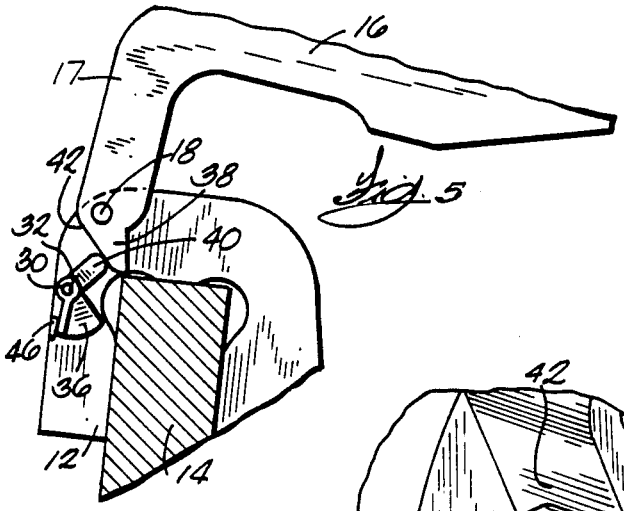
FIG. 5 is a view similar to FIG. 3 with the swivel bracket in the raised position.
Figure 6:
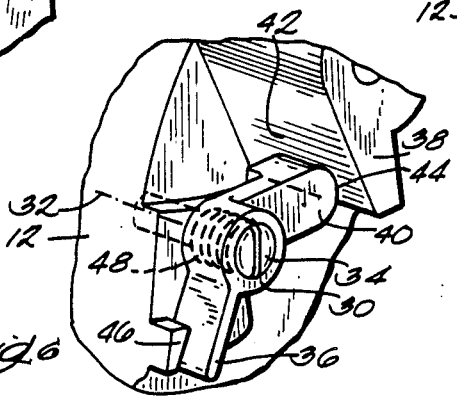
FIG. 6 is a partial, perspective view of the marine propulsion device with the swivel bracket in the raised position.

A marine propulsion device 10 embodying the invention is illustrated in the drawings. As best shown in FIG. 1, the marine propulsion device 10 comprises a transom bracket 12 mounted on the transom of a boat 14, and a swivel bracket 16 mounted on the transom bracket 12 for pivotal movement relative to the transom bracket 12 about a generally horizontal tilt axis 18 and between an operating position (FIGS. 1–3) and a raised position (FIGS. 5 and 6). While any suitable transom bracket and swivel bracket arrangement can be used, in the preferred embodiment, the swivel bracket 16 includes a pair of spaced apart arms 17 (FIGS. 2 and 5) which extend on opposite sides of the transom bracket 12 and which are pivotally connected to the transom bracket 12 for rotation about the tilt axis 18 by a tilt pin 19 (FIG. 2).

The marine propulsion device 10 also comprises a propulsion unit 20 including a rotatably mounted propeller 22, and an engine 24 drivingly connected to the propeller 22. The propulsion unit 20 is mounted on the swivel bracket 16 for pivotal movement relative to the swivel bracket 16 about a generally vertical steering axis 26, and for common movement with the swivel bracket 16 about the tilt axis 18. In the preferred embodiment, the swivel bracket 16 and the propulsion unit 20 have a combined center of gravity which is located rearwardly of the tilt axis 18 when the swivel bracket 16 is in the raised position, so that the swivel bracket 16 and propulsion unit 20 tend to rotate clockwise (as viewed in FIG. 1) when the swivel bracket 16 is in the raised position.

The marine propulsion device 10 also comprises a member 30 mounted on one of the swivel bracket 16 and the transom bracket 12 for movement relative thereto between a first position wherein the member 30 permits location of the swivel bracket 16 in the operating position, and a second position spaced from the first position and wherein the member 30 engages the other of the swivel bracket 16 and the transom bracket 12 for holding the swivel bracket 16 in the raised position. In the preferred embodiment, the member 30 is mounted on the transom bracket 12 for pivotal movement relative to the transom bracket 12 about a generally horizontal pivot axis 32 (FIG. 6). In the illustrated construction, the member 30 is rotatably mounted on a bolt 34 (FIG. 6) which is threaded into the transom bracket 12 and which extends along the pivot axis 32. Preferably, the pivot axis 32 is located slightly in front of and below the tilt axis 18.

It should be understood that in alternative embodiments of the invention, the member 30 can be pivotally mounted on the swivel bracket 16, or can be mounted for linear movement on either of the transom bracket 12 and the swivel bracket 16.

The member 30 includes means for gravitationally biasing the member 30 toward the second position. While various suitable gravitational biasing means can be employed, in the preferred embodiment, such means includes, on the member 30, a weighted portion 36 (FIGS. 3–6). Also, in the preferred embodiment, the member 30 is manually movable from the second position toward the first position to release the swivel bracket 16 from the raised position.

The marine propulsion device 10 also comprises means on the other of the swivel bracket 16 and the transom bracket 12 for engaging the member 30 when the member 30 is in the second position to hold the swivel bracket 16 in the raised position. In the preferred embodiment, wherein the member 30 is mounted on the transom bracket 12, the means for engaging the member 30 is located on the swivel bracket 16. While various suitable means for engaging the member 30 can be used, in the illustrated construction, such means includes (see FIGS. 2–6) a projection 38 extending generally radially from the tilt axis 18. Furthermore, in the preferred embodiment, the means for engaging the member 30 locks the member 30 in the second position, as best shown in FIG. 5. In other words, the swivel bracket 16 is engageable with the member 30 for locking the member 30 in the second position. As a result, the member 30 is manually movable from the second position only after movement of the swivel bracket 16 from the raised position in the direction away from the operating position. (The swivel bracket 16 cannot be moved from the raised position toward the operating position while the member 30 is in the second position because the member 30 prevents such movement.)

The marine propulsion device 10 also comprises means on the other of the swivel bracket 16 and the transom bracket 12 for moving the member 30 to the first position in response to movement of the swivel bracket 16 to the operating position from the raised position. In the preferred embodiment, wherein the member 30 is mounted on the transom bracket 12, the means for moving the member 30 to the first position is located on the swivel bracket 16. While various suitable means can be employed for moving the member 30 to the first position, in the preferred embodiment, such means includes the projection 38. Furthermore, the means for moving the member 30 to the first position preferably operates only after manual movement of the member 30 from the second position to release the swivel bracket 16 from the raised position.

Figure 4:
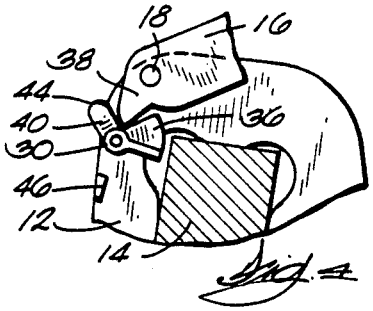
FIG. 4 is a view similar to FIG. 3 with the swivel bracket between the operating position and the raised position.
Figure 3:
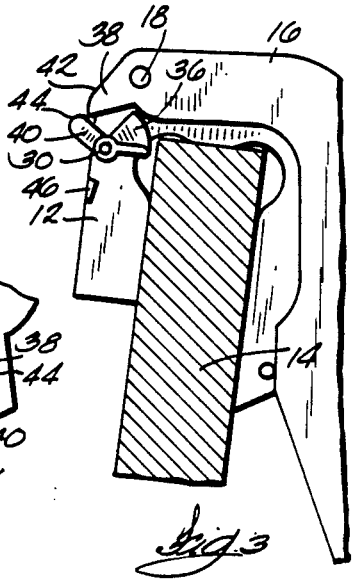
FIG. 3 is an enlarged, partial, side view of the marine propulsion device with the swivel bracket in the operating position.

In the illustrated construction, the weighted portion 36 of the member 30 extends generally radially from the pivot axis 32, and the member 30 includes a projecting portion 40 extending generally radially from the pivot axis 32 and being angularly spaced from the weighted portion 36. In the preferred embodiment, as best shown in FIGS. 3–5, the projecting portion 40 is spaced approximately 120 degrees from the weighted portion 36. Because the propulsion unit 20 and swivel bracket 16 tend to rotate in the clockwise direction (as viewed in FIG. 1) about the tilt axis 18 when the swivel bracket 16 is in the raised position, and because the member 30 is located below the tilt axis 18, the projecting portion 40 extends generally rearwardly of the pivot axis 32 when the member 30 is in the second position so that the projecting portion 40 engages the swivel bracket 16 as shown in FIGS. 5 and 6 and prevents clockwise rotation thereof. Also, in the preferred embodiment, the projecting portion 40 has an outer end 44, and the projection 38 includes a generally planar surface 42 which extends generally perpendicularly to the projecting portion 40 when the swivel bracket 16 is in the raised position and when the member 30 is in the second position, and which engages the outer end 44 of the projecting portion 40.

In the preferred embodiment, the marine propulsion device 10 further comprises (see FIGS. 2–6) stop means 46 on the transom bracket 12 for preventing pivotal movement of the member 30 beyond the second position in the direction from the first position to the second position (clockwise in FIG. 3).

In an alternative embodiment of the invention, which is illustrated in FIG. 6, the marine propulsion device 10 further comprises gravity assist means for biasing the member 30 toward the second position. The gravity assist means aids the means for gravitationally biasing the member 30. While various suitable gravity assist means can be employed, in the appropriate embodiment, the gravity assist means includes spring means 48 operably connected between the transom bracket 12 and the member 30.

The marine propulsion device 10 operates as follows: When the swivel bracket 16 is in the operating position, as shown in FIGS. 1–3, the member 30 is in the first position. When the swivel bracket 16 is moved from the operating position toward the raised position, the weighted portion 36 of the member 30 biases the member 30 toward the second position. Simultaneously, in the preferred embodiment, the projection 38 on the swivel bracket 16 engages the member 30 and rotates the member 30 toward the second position (clockwise in FIG. 4). It should be understood that in alternative embodiments the swivel bracket 16 need not engage the member 30 to move it toward the second position.

When the projecting portion 40 of the member 30 clears the projection 38 as the swivel bracket 16 moves to and slightly beyond the raised position, the member 30 rotates, under the influence of gravity on the weighted portion 36, to the second position. The stop means 46 on the transom bracket 12 prevents movement of the member 30 beyond the second position. Once the member 30 is in the second position, the swivel bracket 16 is lowered slightly to the raised position wherein the projection 38 engages the end 44 of the projecting portion 40 of the member 30 which, in turn, engages the stop means 46 to thereby hold the swivel bracket 16 in the raised position.

To lower the swivel bracket 16 to the operating position, the swivel bracket 16 is first raised slightly from the raised position. This raising of the swivel bracket 16 permits manual movement of the member 30 toward the first position (counter-clockwise in the drawings). Once the member 30 has been manually moved toward the first position, the swivel bracket 16 can be lowered to the operating position. During lowering of the swivel bracket 16, the projection 38 engages the projecting portion 40 of the member 30 to move the member 30 back to the first position.

Various other features and advantages of the invention are set forth in the following claims.

We claim:

1. A marine propulsion device comprising a transom bracket adapted to be mounted on the transom of a boat, a swivel bracket mounted on said transom bracket for pivotal movement relative to said transom bracket about a generally horizontal tilt axis and between an operating position and a raised position, a propulsion unit including a rotatably mounted propeller and being mounted on said swivel bracket for pivotal movement relative to said swivel bracket about a generally vertical steering axis, a member mounted on one of said swivel bracket and said transom bracket for movement relative thereto between a first position wherein said member permits location of said swivel bracket in said operating position, and a second position spaced from said first position, said member including means for gravitationally biasing said member toward said second position, means on the other of said swivel bracket and said transom bracket for engaging said member when said member is in said second position to hold said swivel bracket in said raised position, and means on said other of said swivel bracket and said transom bracket for moving said member to said first position in response to movement of said swivel bracket to said operating position from said raised position.

2. A marine propulsion device as set forth in claim 1 wherein said other of said swivel bracket and said transom bracket includes a projection extending generally radially from said tilt axis, and wherein said means for moving said member to said first position includes said projection.

3. A marine propulsion device as set forth in claim 2 wherein said means for engaging said member includes said projection.

4. A marine propulsion device as set forth in claim 1 and further comprising stop means on said one of said swivel bracket and said transom bracket for preventing movement of said member beyond said second position in the direction from said first position to said second position.

5. A marine propulsion device comprising a transom bracket adapted to be mounted on the transom of a boat, a swivel bracket mounted on said transom bracket for pivotal movement relative to said transom bracket about a generally horizontal tilt axis and between an operating position and a raised position, a propulsion unit including a rotatably mounted propeller and being mounted on said swivel bracket for pivotal movement relative to said swivel bracket about a generally vertical steering axis, a member mounted on one of said swivel bracket and said transom bracket for movement relative thereto between a first position wherein said member permits location of said swivel bracket in said operating position, and a second position spaced from said first position and wherein said member engages the other of said swivel bracket and said transom bracket for holding said swivel bracket in said raised position, said member including means for gravitationally biasing said member toward said second position, and means on said other of said swivel bracket and said transom bracket for moving said member to said first position in response to movement of said swivel bracket to said operating position from said raised position.

6. A marine propulsion device as set forth in claim 5 wherein said other of said swivel bracket and said transom bracket includes a projection extending generally radially from said tilt axis, and wherein said means for moving said member to said first position includes said projection.

7. A marine propulsion device as set forth in claim 6 wherein said projection engages said member when said member is in said second position.

8. A marine propulsion device as set forth in claim 5 and further comprising stop means on said one of said swivel bracket and said transom bracket for preventing movement of said member beyond said second position in the direction from said first position to said second position.

9. A marine propulsion device comprising a transom bracket adapted to be mounted on the transom of a boat, a swivel bracket mounted on said transom bracket for pivotal movement relative to said transom bracket about a generally horizontal tilt axis and between an operating position and a raised position, a propulsion unit including a rotatably mounted propeller and being mounted on said swivel bracket for pivotal movement relative to said swivel bracket about a generally vertical steering axis, a member mounted on said transom bracket for pivotal movement relative to said transom bracket about a generally horizontal pivot axis and between a first position wherein said member permits location of said swivel bracket in said operating position, and a second position spaced from said first position, said member including a weighted portion gravitationally biasing said member toward said second position, and said member being manually movable from said second position toward said first position, means on said swivel bracket for engaging said member when said member is in said second position to hold said swivel bracket in said raised position, and means on said swivel bracket for moving said member to said first position only after manual movement of said member from said second position and in response to movement of said swivel bracket to said operating position from said raised position.

10. A marine propulsion device as set forth in claim 9 wherein said weighted portion extends generally radially from said pivot axis, wherein said member includes a projecting portion extending generally radially from said pivot axis and being angularly spaced from said weighted portion, and wherein said means for engaging said member engages said projecting portion.

11. A marine propulsion device as set forth in claim 10 wherein said means for engaging said member includes a generally planar surface which extends generally perpendicularly to said projecting portion when said swivel bracket is in said raised position and when said member is in said second position.

12. A marine propulsion device as set forth in claim 10 wherein said projecting portion extends generally rearwardly of said pivot axis when said member is in said second position.

13. A marine propulsion device as set forth in claim 10 wherein said projecting portion has an outer end, and wherein said means for engaging said member engages said outer end of said projecting portion.

14. A marine propulsion device as set forth in claim 9 wherein said swivel bracket includes a projection extending generally radially from said tilt axis, and wherein said means for moving said member to said first position and said means for engaging said member both include said projection.

15. A marine propulsion device as set forth in claim 14 wherein said weighted portion extends generally radially from said pivot axis, wherein said member includes a projecting portion extending generally radially from said pivot axis, having an outer end, and being angularly spaced from said radial portion, and wherein said projection engages said outer end of said projecting portion.

16. A marine propulsion device as set forth in claim 9 and further comprising stop means on said transom bracket for preventing pivotal movement of said member beyond said second position in the direction from said first position to said second position.

17. A marine propulsion devide as set forth in claim 9 wherein said swivel bracket is engageable with said member for locking said member in said second position.

18. A marine propulsion device as set forth in claim 17 wherein said member is manually movable from said second position only after movement of said swivel bracket from said raised position in the direction away from said operating position.

19. A marine propulsion device as set forth in claim 9 and further comprising gravity assist means for biasing said member toward said second position.

20. A marine propulsion device as set forth in claim 19 wherein said gravity assist means includes spring means operably connected between said transom bracket and said member.

* * * * *